US009273559B2

(12) United States Patent
Knorr et al.

(10) Patent No.: US 9,273,559 B2
(45) Date of Patent: Mar. 1, 2016

(54) TURBINE BLADE COOLING CHANNEL FORMATION

(71) Applicant: General Electric Company, Schenectady, NY (US)

(72) Inventors: David Bruce Knorr, Clifton Park, NY (US); Kathleen Blanche Morey, Scotia, NY (US)

(73) Assignee: General Electric Company, Schenectady, NY (US)

( * ) Notice: Subject to any disclaimer, the term of this patent is extended or adjusted under 35 U.S.C. 154(b) by 498 days.

(21) Appl. No.: 13/790,615

(22) Filed: Mar. 8, 2013

(65) Prior Publication Data

US 2014/0255206 A1 Sep. 11, 2014

(51) Int. Cl.

| | |
|---|---|
| ***F01D 5/18*** | (2006.01) |
| ***F01D 5/28*** | (2006.01) |
| ***F01D 5/14*** | (2006.01) |

(52) U.S. Cl.

CPC ..... *F01D 5/183* (2013.01); *F01D 5/147* (2013.01); *F01D 5/286* (2013.01); *F01D 5/288* (2013.01); *F05D 2230/11* (2013.01); *F05D 2230/31* (2013.01); *F05D 2230/90* (2013.01); *F05D 2260/204* (2013.01); *F05D 2300/514* (2013.01)

(58) Field of Classification Search

CPC ..... F01D 5/183; F01D 5/288; F01D 5/286; F01D 5/147

USPC ..... 416/97 A

See application file for complete search history.

(56) References Cited

U.S. PATENT DOCUMENTS

| | | | | |
|---|---|---|---|---|
| 4,049,580 | A | 9/1977 | Oden et al. | |
| 4,169,025 | A | 9/1979 | Needes | |
| 4,251,344 | A | 2/1981 | Needes | |
| 4,503,251 | A | 3/1985 | Gray et al. | |
| 4,513,149 | A | 4/1985 | Gray et al. | |
| 5,176,499 | A | 1/1993 | Damlis et al. | |
| 5,279,111 | A | 1/1994 | Bell et al. | |
| 6,129,991 | A | 10/2000 | Warnes et al. | |
| 6,602,053 | B2 | 8/2003 | Subramanian et al. | |
| 7,901,790 | B2 * | 3/2011 | Arikawa ..... | F01D 5/288 416/241 R |

* cited by examiner

*Primary Examiner* — Zelalem Eshete

(74) *Attorney, Agent, or Firm* — Ernest G. Cusick; Hoffman Warnick LLC

(57) ABSTRACT

Embodiments of the invention relate generally to turbine blades and, more particularly, to the formation of cooling channels on a surface of a turbine blade and turbine blades including such cooling channels. In one embodiment, the invention provides a method of forming a cooling channel along a surface of a turbine blade, the method comprising: applying a first mask material to a first portion of a surface of a turbine blade; forming a first barrier layer atop the first mask material and atop a second portion of the surface of the turbine blade; removing the first mask material and the barrier layer atop the first mask material to expose the first portion of the surface of the turbine blade; and etching the first portion of the surface of the turbine blade to form a cooling channel along the surface of the turbine blade.

20 Claims, 5 Drawing Sheets

TURBINE BLADE COOLING CHANNEL FORMATION

BACKGROUND OF THE INVENTION

Embodiments of the invention relate generally to turbine blades and, more particularly, to the formation of cooling channels on a surface of a turbine blade and turbine blades including such cooling channels.

Turbine blades employed in high-temperature applications are typically a nickel-based super alloy and covered with a metallic bond coat and a ceramic thermal barrier coating. Embodiments of the invention facilitate improved cooling of a turbine blade, as compared to known configurations and methods of forming cooling channels. In turn, this enables use of the turbine blade in hot gas paths having a higher temperature, the use of a thinner thermal barrier coating, and a reduced cost, as compared to the use of nickel alloys. In some cases, cooling passages within the turbine blade may be simplified, since more of the active cooling of the turbine blade occurs at the blade surface. In addition, all cooling channels may be fabricated simultaneously, which reduces expense as compared to known methods of cooling channel formation, such as by water jet or electro-discharge machining.

BRIEF DESCRIPTION OF THE INVENTION

In one embodiment, the invention provides a method of forming a cooling channel along a surface of a turbine blade, the method comprising: applying a first mask material to a first portion of a surface of a turbine blade; forming a first barrier layer atop the first mask material and atop a second portion of the surface of the turbine blade; removing the first mask material and the barrier layer atop the first mask material to expose the first portion of the surface of the turbine blade; and etching the first portion of the surface of the turbine blade to form a cooling channel along the surface of the turbine blade.

In another embodiment, the invention provides a method of coating a turbine blade, the method comprising: aluminizing a metal layer of the turbine blade surface; converting the aluminized metal layer to an aluminide layer; and removing aluminum from the aluminide layer, forming a porous metal layer.

In still another embodiment, the invention provides a turbine blade comprising: a nickel-based superalloy airfoil; an oxidized porous metal layer on a surface of the airfoil; and a thermal barrier coating over the oxidized porous material.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
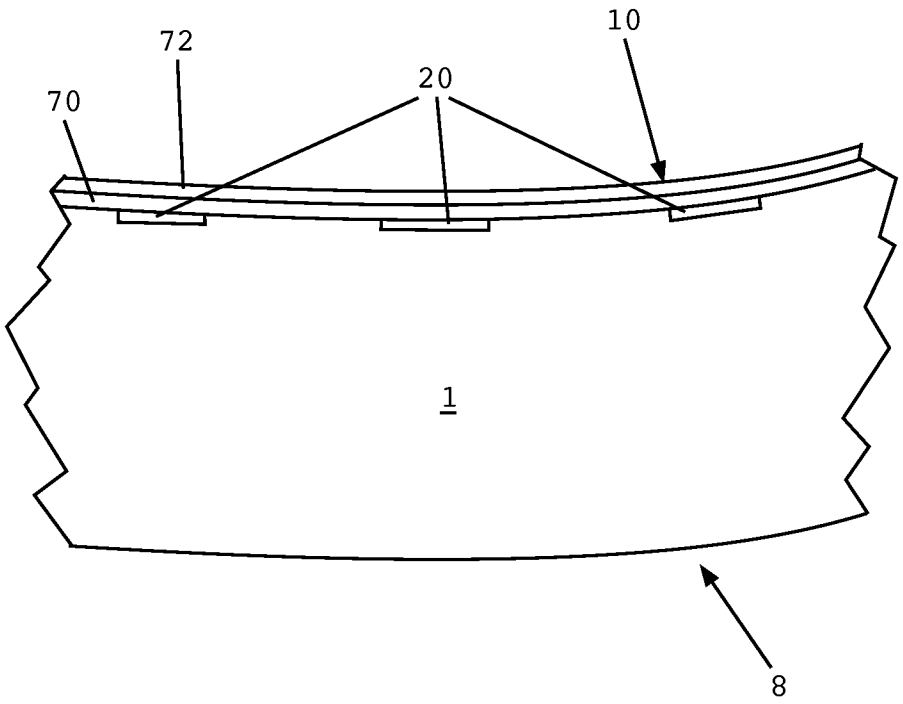
FIG. 1 shows a perspective view of a turbine blade according to an embodiment of the invention.

FIG. 1 shows a cross-sectional side view of a portion of a turbine blade 1 according to an embodiment of the invention. Turbine blade 1 includes a leading surface 8 and a trailing surface 10. A plurality of cooling channels 20 have been formed along trailing surface 10 according to one method of the invention. A bond coat layer 70 and thermal barrier coating layer 72 are formed atop trailing surface 10 and cover the plurality of cooling channels 20. Although cooling channels 20 are shown only along trailing surface 10 in FIG. 1, it should be appreciated that cooling channels may similarly be placed along leading surface 8 rather than or in addition to trailing surface 10.

Figure 2:
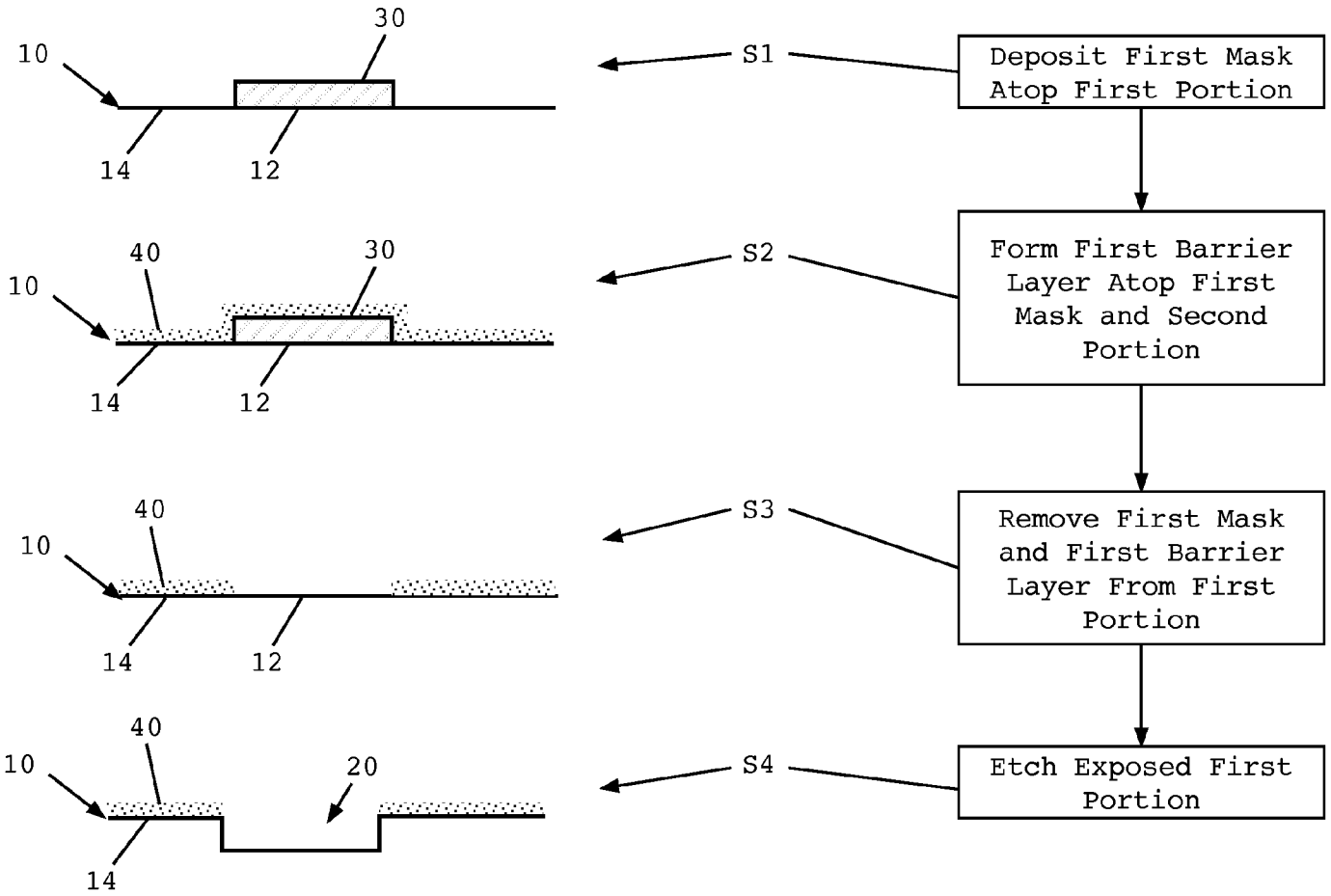
FIG. 2 shows a flow diagram and cross-sectional side views of a method according to an embodiment of the invention.

FIG. 2 shows a flow diagram and accompanying cross-sectional side views of a method according to one embodiment of the invention. At S1, a first mask material 30 is deposited atop a surface 10 of a turbine blade. Mask materials suitable for use according to embodiments of the invention include, for example, photoresist or a polymer material. First mask material 30 may be deposited using a number of methods or techniques, including, for example, dipping, spraying, or vapor deposition. The particular method or technique employed will depend, at least in part, on first mask material 30. First mask material 30 may be discretely deposited or may be deposited across a larger area and then patterned. As shown in FIG. 2, first mask material 30 covers a first portion 12 of surface 10, leaving a second portion 14 exposed. First portion 12 includes an area or areas of surface 10 in which cooling channels are to be formed. Second portion 14 includes areas of surface 10 in which cooling channels are not to be formed and may comprise some or all of surface 10 other than first portion 12. One skilled in the art will recognize, of course, that materials and deposition techniques other than those disclosed may be employed.

At S2, a first barrier layer 40 is formed atop surface 10, covering both first mask material 30 and second portion 14 of surface 10. First barrier layer 40 may include, for example, Titanium oxynitride, $TiO_2$, $TaO_2$, TiN, $SiO_2$, and high melting point oxides, such as aluminum oxide. First barrier layer 40 may be formed using any number of methods or techniques, including, for example, chemical vapor deposition, sputtering, or reactive sputtering. The particular method or technique employed will depend, at least in part, on first barrier layer 40. At S3, first mask material 30 is removed, along with the portion of barrier layer 40 atop first mask material 30, exposing first portion 12 of surface 10. First portion 12 may then be etched at S4 to form cooling channel 20 in surface 10. Etching first portion 12 may include any number of methods or techniques, including, for example, liquid chemical etching and reactive ion etching.

Figure 3:
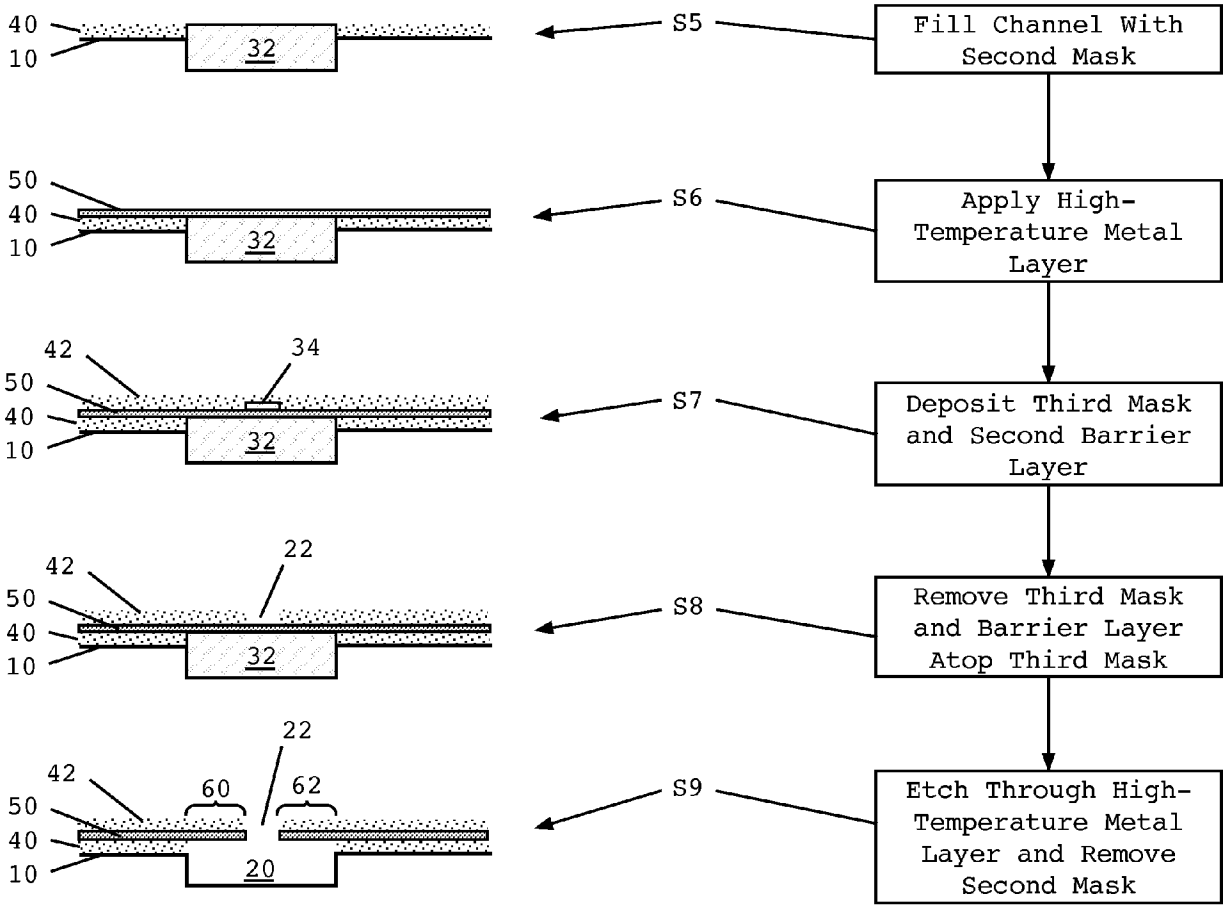
FIG. 3 shows a flow diagram and cross-sectional side views of a method according to another embodiment of the invention.

In some embodiments of the invention, cooling channels 20 may be further processed to form overhanging structures above the cooling channels 20. This effectively reduces an opening to the cooling channel 20, which may be desirable in some circumstances. FIG. 3 shows a flow diagram and accompanying cross-sectional side views of a method of forming such overhanging structures. At S5, cooling channel 20 is filled with a second mask material 32. Second mask material 32 may be the same as first mask material 30 (FIG. 2) or may be a different mask material. Similarly, second mask material 32 may be deposited using the same method or technique as first mask material 30 or by a different method or technique.

At S6, a high-temperature metal layer 50 is deposited, formed, or applied atop second mask material 32 and first barrier layer 40. High-temperature metal layer 50 may include, for example, a nickel-based super alloy or a refractory metal and may be deposited, formed, or applied using any number of methods or techniques, such as vapor deposition, sputtering, or electrochemical deposition.

A third mask material 34 and second barrier layer 42 are then deposited or formed atop high-temperature metal layer 50 at S7. As can be seen in FIG. 3, third mask material 34 is deposited such that, in at least one dimension, its width is less than that of cooling channel 20. The deposition or forming of third mask material 34 and second barrier layer 42 are similar to the deposition or forming of first mask material 30 and first barrier layer 40 in FIG. 2. Third mask material 34 may be the same as first mask material 30 or second mask material 32 or may be a different mask material and may be deposited using the same or a different method or technique. Similarly, second barrier layer 42 may be the same as first barrier layer 40 or may be a different mask material and may be deposited using the same or a different method or technique.

At S8, third mask material 34 and the portion of second barrier layer 42 atop third mask material 34 are removed, similar to the removal of first mask material 40 and a portion of first barrier layer 40 at S3 of FIG. 2. At S9, high-temperature metal layer 50 is etched where exposed by the removal of third mask material 34 and second barrier layer 42, forming an opening 22 through which second mask material 32 is removed from cooling channel 20. As can be seen in FIG. 3, the smaller dimension of third mask material 34, as compared to cooling channel 20, results in overhangs 60, 62 of high-temperature metal layer 50 and second barrier layer 42 above cooling channel 20.

Figure 4:
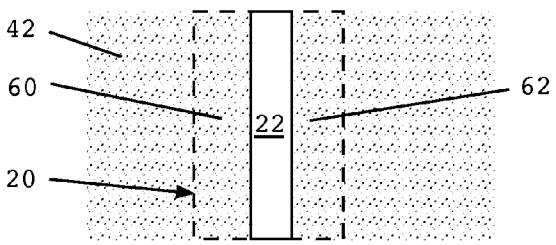
FIGS. 4 and 5 show schematic top views of cooling channels formed according to embodiments of the invention.
Figure 5:
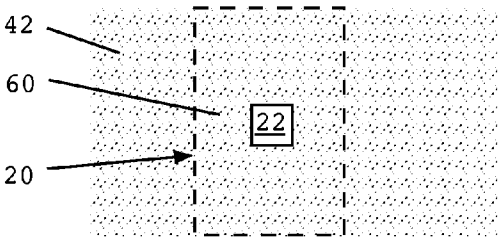

FIG. 4 shows a top view of a cooling channel 20 according to one embodiment of the invention. For ease of illustration and explanation, only second barrier layer 42 is shown. One skilled in the art will recognize, however, that high-temperature metal layer 50 lies below second barrier layer 42. In FIG. 4, overhangs 60, 62 reside adjacent opening 22 and over a portion of cooling channel 20. Other configurations are possible. In FIG. 5, for example, overhang 60 is continuous around a substantially square opening 22.

Figure 6:
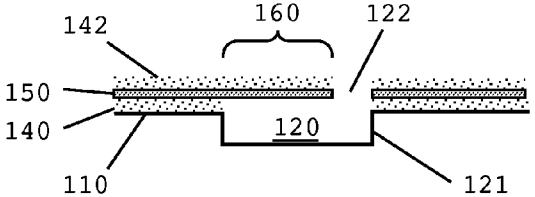
FIG. 6 shows a cross-sectional side view of a step of a method according to an embodiment of the invention.
Figure 7:
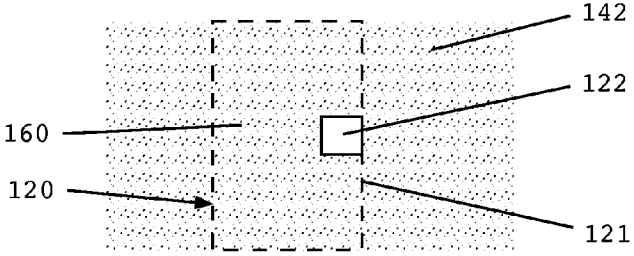
FIGS. 7-9 show schematic top views of cooling channels formed according to embodiments of the invention.
Figure 8:
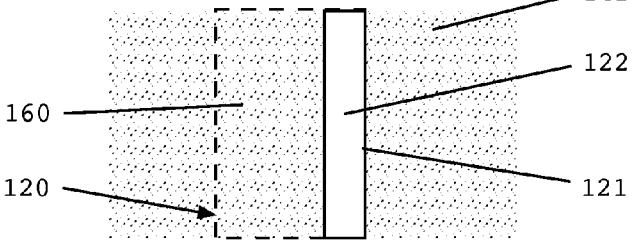
Figure 9:
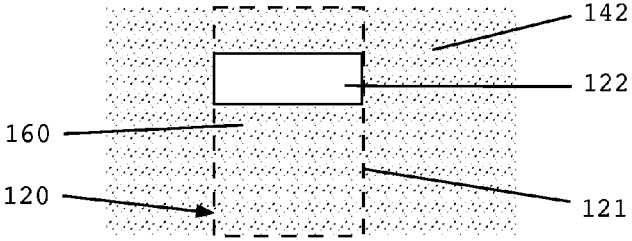

FIG. 6 shows a cross-sectional view of another embodiment of the invention. Here, opening 122 is offset and substantially flush with a wall 121 of cooling channel 120. As such, a single overhang 160 is formed above cooling channel 120. FIGS. 7-9 show top views of various arrangements of opening 122 relative to cooling channel 120 according to such an embodiment.

In FIGS. 3-9, opening 22, 122 is shown as being substantially square- or rectangular-shaped. This is neither necessary nor essential, however, and openings formed according to the various embodiments of the invention may have any number of two-dimensional shapes.

In any of the embodiments of the invention, once surface 10, 110 is etched to form cooling channel 20, 120, a metallic bond coat, such as MCrAlY, may be applied in a manner that is sufficient to cover first barrier layer 40 or second barrier layer 140, as well as to cover the surfaces of, but not fill, cooling channel 20, 120. Similarly, in any of the embodiments of the invention, the cooling channel 20, 120 formed may be joined to a source of cooling fluid, such as air or steam, for example, within the turbine blade 1 (FIG. 1). For example, once cooling channel 20, 120 is formed, a passage may be formed, such as by drilling, from a bottom surface of the cooling channel 20, 120 through to a source of cooling air in the center of the turbine blade.

In some embodiments of the invention, high-temperature metal layer 50, 150 includes a porous metal layer. Use of such a porous metal layer reduces stress in a thermal barrier coating (TBC) applied to the turbine blade during later processing steps, since it is more compliant than either the turbine blade itself or the TBC. Porous metal layers also reduces the thermal diffusivity, as compared to a similar non-porous metal layers. This increases the temperature drop between the hot gas and the turbine blade.

Figure 10:
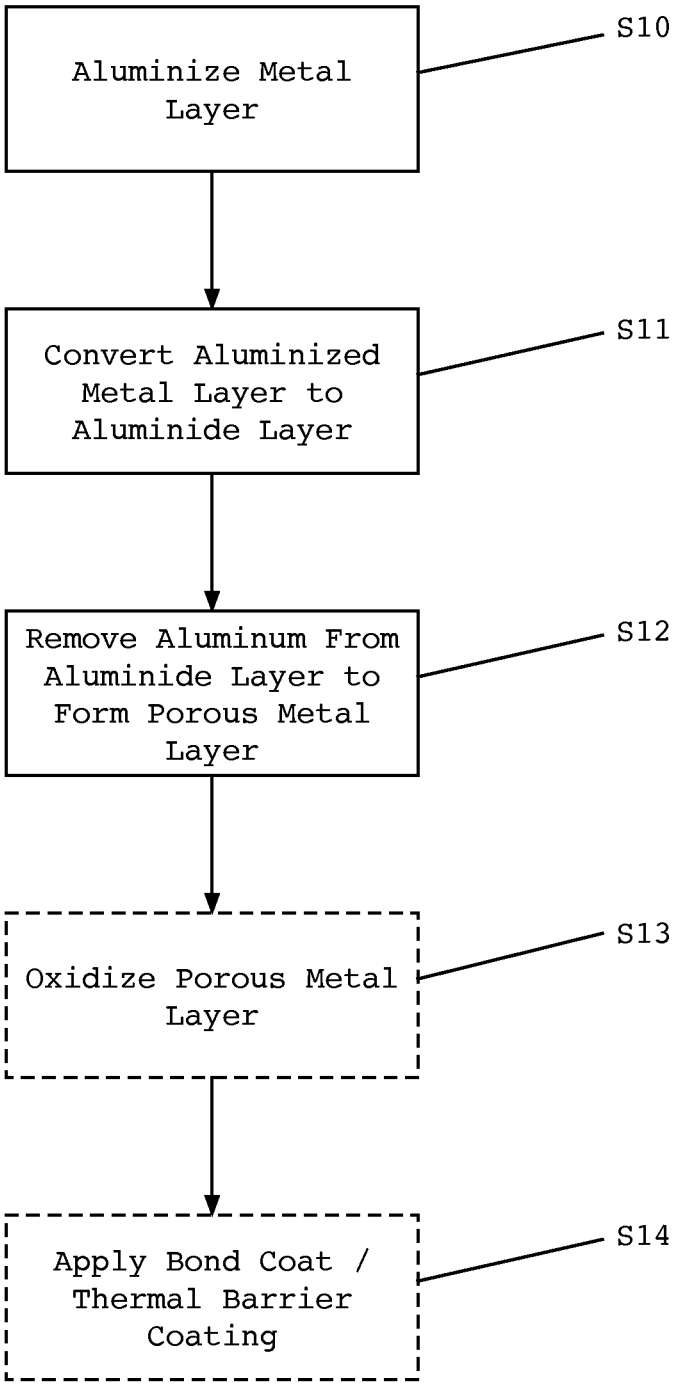
FIG. 10 shows a flow diagram of a method according to another embodiment of the invention.

FIG. 10 shows a flow diagram of a method of forming a porous metal layer on a turbine blade according to an embodiment. At S10, a metal layer, for example, 42 in FIG. 3, is aluminized. This may be achieved using any number of methods or techniques, including, for example, dipping the metal layer in an aluminum bath, spray depositing aluminum onto the metal layer, or vapor depositing aluminum onto the metal layer.

At S11, the aluminized metal layer is converted to an aluminide layer. Typically, this is achieved by heating the aluminized metal layer to a temperature between about 660° C. and about 1200° C. in the absence of oxygen.

At S12, aluminum is removed from the aluminide layer to form a porous metal layer. The aluminum may be removed using any number of methods or techniques, but is typically removed by applying a caustic solution to the aluminide layer. Where the metal layer was a nickel alloy, the porous metal layer thus formed comprises a porous nickel alloy layer.

A number of additional processes may be carried out on the porous metal layer. For example, at S13, the porous metal layer may optionally be passivated by oxidation. This may be desirable, for example, where the metal layer will be exposed to high temperatures, since the high surface area of the porous metal layer is likely to be pyrophoric. Oxidizing the porous metal layer may be achieved by, for example, heating in air around 400 C.

At S14, a bond coat and/or thermal barrier coating may optionally be applied to the porous metal layer formed at S12 or the oxidized porous metal layer formed at S13.

As described herein, the porous metal layer is formed from high-temperature metal layer 50, 150, although other metal layers may similarly be made porous to provide increased compliance. For example, the nickel-based superalloy of the turbine blade itself may be made porous using the method described above or a similar method. In addition, the turbine blade may be coated with a layer of a nickel-based heat resistant alloy which is then made porous using the method described above or a similar method.

In any case, additional layers may be deposited atop the porous metal layer to complete the finishing of the turbine blade. For example, in some embodiments of the invention, a turbine blade comprises a nickel-based superalloy airfoil, an oxidized porous metal layer on a surface of the airfoil, a bond coat, and a thermal barrier coating over the oxidized porous material.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of forming a cooling channel along a surface of a turbine blade, the method comprising:

applying a first mask material to a first portion of a surface of a turbine blade;

forming a first barrier layer atop the first mask material and atop a second portion of the surface of the turbine blade;

removing the first mask material and the barrier layer atop the first mask material to expose the first portion of the surface of the turbine blade; and etching the first portion of the surface of the turbine blade to form a cooling channel along the surface of the turbine blade.

2. The method of claim 1, further comprising:

applying a metallic bond coat to the surface of the turbine blade sufficient to cover but not fill the cooling channel.

3. The method of claim 1, further comprising:

forming a passage between the cooling channel and cooling source within the turbine blade.

4. The method of claim 1, further comprising:

filling the cooling channel with a second mask material;

depositing a high-temperature metal layer atop the second mask material and the second portion of the surface of the turbine blade;

depositing a third mask material atop the high-temperature metal layer;

depositing a second barrier layer atop the third mask material and the high-temperature metal layer;

removing the third mask material and the second barrier layer atop the third mask material;

etching the high-temperature metal layer through to the second mask material; and removing the second mask material.

5. The method of claim 4, further comprising:

applying a metallic bond coat to the surface of the turbine blade sufficient to cover but not fill the cooling channel.

6. The method of claim 4, wherein the cooling channel has a first width and etching the high-temperature metal layer includes etching the high-temperature metal layer to a second width that is less than the first width, such that at least a portion of the high-temperature metal layer extends over the cooling channel.

7. The method of claim 4, wherein the high-temperature metal layer includes a porous metal layer.

8. The method of claim 4, wherein depositing the high-temperature metal layer includes forming a porous metal layer by:

aluminizing the high-temperature metal layer;

converting the aluminized high-temperature metal layer to an aluminide layer; and removing aluminum from the aluminide layer to form the porous metal layer.

9. The method of claim 8, wherein aluminizing includes at least one of the following: dipping the high-temperature metal layer in an aluminum bath, spray depositing aluminum onto the high-temperature metal layer, or vapor depositing aluminum onto the high-temperature metal layer.

10. The method of claim 8, wherein removing aluminum from the aluminide layer includes leaching aluminum from the aluminide layer using a caustic solution.

11. The method of claim 8, further comprising:

oxidizing the porous metal layer.

12. The method of claim 1, wherein the first mask material is selected from a group consisting of: photoresists and polymer materials.

13. The method of claim 1, wherein the first barrier layer includes at least one material selected from a group consisting of: Titanium oxynitride, $TiO_2$, $TaO_2$, TiN, $SiO_2$, aluminum oxide, and refractory metal oxide.

14. A method of coating a turbine blade, the method comprising:

aluminizing a metal layer of the turbine blade surface;

converting the aluminized metal layer to an aluminide layer; and removing aluminum from the aluminide layer, forming a porous metal layer.

15. The method of claim 14, further comprising:

oxidizing the porous metal layer.

16. The method of claim 15, further comprising:

applying at least one of a bond coat or a thermal barrier coating to the oxidized porous metal layer.

17. The method of claim 14, wherein the metal layer is selected from a group consisting of: a nickel-based superalloy of the turbine blade, a nickel-based alloy applied to the turbine blade surface, and a metallic bond coat atop the turbine blade surface.

18. The method of claim 14, wherein:

aluminizing includes at least one of the following: dipping the metal layer in an aluminum bath, spray depositing aluminum onto the metal layer, or vapor depositing aluminum onto the metal layer;

converting the aluminized metal layer to an aluminide layer includes heating the aluminized metal layer to a temperature between about 660° C. and about 1200° C.; and removing aluminum from the aluminide layer includes leaching aluminum from the aluminide layer using a caustic solution.

19. A turbine blade comprising:

a nickel-based superalloy airfoil;

an oxidized porous metal layer on a surface of the airfoil; and at least one of a bond coat or a thermal barrier coating over the oxidized porous material.

20. The turbine blade of claim 19, further comprising:

at least one cooling channel along the surface of the airfoil; and at least one passage between the at least one cooling channel and a source of coolant within the turbine blade.

* * * * *